US006457636B1

(12) United States Patent
Van de Ven et al.

(10) Patent No.: US 6,457,636 B1
(45) Date of Patent: Oct. 1, 2002

(54) FOLDABLE U-SHAPED PROFILE, ITS MANUFACTURING PROCESS AND INSTALLATION FOR EMBODIMENT OF THE PROCESS

(75) Inventors: Jacques Van de Ven, Villars (CH); Thierry Birkel, Vandoeuvre les Nancy (FR); Hannes Heertjes, Nuenen (NL)

(73) Assignee: ITW Litec France, Tournus (FR)

( * ) Notice: Subject to any disclaimer, the term of this patent is extended or adjusted under 35 U.S.C. 154(b) by 0 days.

(21) Appl. No.: 09/472,204

(22) Filed: Dec. 27, 1999

(30) Foreign Application Priority Data

Dec. 28, 1998 (FR) ..... 98 16494

(51) Int. Cl.[7] ..... B65D 21/04; B65D 6/16

(52) U.S. Cl. ..... 229/122.32; 206/517; 220/4.26; 220/DIG. 25

(58) Field of Search ..... 229/122.32; 206/453, 206/499, 517, 592; 220/4.26, DIG. 25; 249/136, 170

(56) References Cited

U.S. PATENT DOCUMENTS 769,915 A * 9/1904 Nostrand ..... 206/517
2,198,634 A * 4/1940 Richter ..... 249/170
2,961,123 A * 11/1960 Boydak et al. ..... 206/517
3,275,188 A * 9/1966 Wilson ..... 206/517
3,339,722 A * 9/1967 Antwerpen ..... 206/453
3,669,338 A 6/1972 Cornell et al.
4,976,374 A * 12/1990 Macaluso ..... 229/122.32
5,947,290 A * 9/1999 Loeschen ..... 206/517

FOREIGN PATENT DOCUMENTS

WO WO89/09733 10/1989

* cited by examiner

*Primary Examiner*—Gary E. Elkins
(74) *Attorney, Agent, or Firm*—Lowe Hauptman Gilman & Berner, LLP

(57) ABSTRACT

A packing member formed as a U-shaped channel comprises a base (1*a*) and two side legs (1*b*, 1*c*). The base is provided with a longitudinal folding line (2') near its median line. The folding line divides the bases into two parts which are pivotable about the folding line. When the two parts are pivoted away from each other with the legs flared outward, the U-channel structure will be transformed into a substantially W-shaped structure to facilitate stacking for storage and/or shipping of the packing member.

32 Claims, 5 Drawing Sheets

FOLDABLE U-SHAPED PROFILE, ITS MANUFACTURING PROCESS AND INSTALLATION FOR EMBODIMENT OF THE PROCESS

The invention concerns a collapsible U-channel, in particular made of cardboard, its fabrication method and equipment to implement said method.

The use of U-channels in particular for packing is known.

The European patent 0,411,045 for instance describes a packing container to pack long articles and comprising two U-channels nested in each other.

To manufacture such structures, it is known in particular to adhesively paste paper or cardboard strips and optionally to cover them with a wrap made for instance of a strong material such as cardboard.

Again is it known to flame-laminate composite cardboard-polyolefin strips to implement diverse structures and in particular U-channels.

As regards the fabrication methods for such U-channels based on strong strips, the only known method consists in bonding the strips to each other while flat and then, using a sequence of shaping stations, to make two main folds on the planar strip product and to carry out the folding operation progressively so as to ultimately arrive at a structure with a U cross-section.

When this method is carried out, the adhesive layers rapidly bond to each other strongly either on account of the action of the adhesive which is used for cardboard strips or on account of the flame-heated polyethylene in the case of composite strips of cardboard and polyethylene.

The U-channel made by this technique is rigid and the angle subtended between the base of the U and each of its two legs in general is close to 90° and cannot be modified when the adhesive is setting. Following manufacture, a substantial modification of this angle and spreading the legs in a direction perpendicular to the longitudinal U-channel axis entails degradation of said channel by delaminating its constituent strips and consequently makes this channel useless.

The U-channels made by this technique can be stacked only with difficulty, contrary to the case of the L-structures. The sole known way to stack them compactly consists in stacking them pairwise with one channel inverted over two others, that is each channel straddles one of the legs of another.

It is easily understood that the rigid channels made by these procedures entail high shipping and/or storage costs after they have in general been put on pallets, considering the substantial volume taken up by such stacks in relation to the actual material involved.

Unit shipping costs will be the larger the larger the dimensions of the U-channels.

The objective of the present invention in particular is to remedy such drawbacks and to optimize stacking these U-channels by eliminating or reducing as best possible the dead volumes regardless of the dimensions of the U-channels.

In order to optimize channel stacking in this manner, the invention proposes a U-channel, comprising a base and two side legs, which is characterized in particular in that it comprises a longitudinal folding line at its base, said line in particular being situated near the median base line in such manner that said base is able to fold inward while at the same time the legs flare outward in such a way that the structure may assume a substantial W-shape, thereby facilitating in particular its storage and/or its shipping.

Another objective of the invention is a manufacturing method for such a U-channel, where this method is characterized by including a stage forming a longitudinal folding line in the base of the structure during the fabrication of this U-channel.

Advantageously the folding line is implemented on a planar, semi-finished product before the U-channel legs will be made by folding.

As regards the manufacture of a U-channel based on bonded strips, in particular made of cardboard or of cardboard-polyolefins composites, the invention proposes implementing this folding line by a grooving operation.

Illustratively this grooving operation may be carried out by impression, without removing material, or by milling with removal of material, or by incision on the inside of the base.

In one embodiment of the invention, the folding line is reinforced at least on one of the base sides by an apposed reinforcing tape.

In the latter case and as regards an incised groove, the invention places the reinforcing tape above the incision by forming at this site a pleat to allow folding the U-channel.

In another embodiment of the invention, the reinforcing tape wraps a large part of the structure except at least one portion of one of the base's sides of said structure at the site of the folding line.

The invention furthermore proposes another method which is characterized by joining two L-structures that are abutted to each other by their legs by a junction tape affixed on said legs.

Lastly the invention also proposes equipment with which to carry out the above methods and characterized in that it comprises beyond the known U-channel manufacturing stations also a grooving station that shall longitudinally groove that portion of the structure that shall constitute the base of said U-channel.

The invention is elucidated in the following description and in relation to the attached drawings.

FIG. 1 schematically shows a cross-section of a stack of conventional U-channels, FIG. 2 schematically shows a cross-section of a stack of U-channels of the invention, FIGS. 3, 4, 5 show a U-channel of the invention fitted with a folding line made in three implementing modes, FIGS. 6, 7, 8 show equipment manufacturing stations for the structures of the invention, in particular for the U-channels resp. shown in FIGS. 3, 4, 5, FIGS. 9 through 19 show end views of various structures of the invention, namely in their use configuration (a) and in their stacking configuration (b), namely in the W shape, FIG. 20 shows one of the manufacturing stages of the channel of FIG. 16.

FIG. 1 schematically shows a stack of conventional U-channels.

In this case the U-channels are combined pairwise upside-down and straddling each other.

The enormous bulk entailed in storage and/or shipping such conventional U-channels is easily noted.

FIG. 2, on the other hand, shows a stack of structures of the invention and illustrates how the latter allow optimized stacking with a high gain compactness.

The following Figures illustrate the particulars and the manner of manufacturing the U-channels of the invention.

FIGS. 3, 4 and 5 show three embodiments of the invention.

The U-channels 1 shown in said FIGS. 3, 4 and 5 consist of a base 1*a* and of two side legs 1*b* and 1*c*.

As clearly shown by FIGS. 3 through 5, the base 1 a is fitted near its median line and over its full length with a folding line 2, 2', 2" designed to act as a hinge. However it is obvious that said folding line may be offset from said median line.

Each shown folding line 2, 2', 2" in FIGS. 3, 4 and 5 is in the form of a groove in its broadest sense, the groove 2 of FIG. 3 being implemented by impressing the material so that the concave impressed side is the inside of the channels base 1*a*, the groove 2' being implemented by removing material from the outside of the channel's base 1*a* and the groove 2" being implemented by incision in the inside of the channel's base 1*a*.

The structures are manufactured partly in known manner, for instance based on mechanically strong strips or sheets, in particular cardboard or in the form of a cardboard-polyolefins composite, which are mutually bonded.

In general the folding line is made during the manufacturing procedure when the product still is planar, that is before the wings are folded into place.

To implement the folding lines shown in FIGS. 3 through 5, manufacturing stations of the sort shown in FIGS. 6, 7 and 8 may be used, said Figures showing the manufacture of a semi-finished strip 3 processed between two rotary means resp. 4, 5; 6, 7; 8, 9.

Said means 4, 5 of FIG. 6 are rollers or cylinders resp. comprising a circumferential protrusion 4' in one and a corresponding slot 5' in the other to allow impressing the material to manufacture a U-channel of FIG. 3.

If the means 7 and 9 of FIGS. 7 and 8 are smooth rollers or cylinders, the means 6 shall be a milling device, that is implementing removal of material, and the means 8 shall be a roller fitted with a circular knife 8' to incise the material, the stations shown in FIGS. 7 and 8 being used to manufacture channels resp. shown in FIGS. 4 and 5.

The manufacturing stations shown in FIGS. 6, 7 and 8 are conFigured between two conventional U-channel manufacturing stations such as stations bonding and pressing the strips, shaping stations (folding into legs), and the optional wrapping, sectioning stations, etc.

Accordingly the invention relates not only to U-channels fitted with a folding line 2, 2', 2" in the channel's base 1*a*, but also to the manufacturing method and the implementing means.

It is easily understood that the structures so made may assume a W-shape in storage and/or shipping, in the manner shown in particular in FIG. 2, by merely spreading the legs 1*b*, 1*c* from each other while keeping the ability to resume the operational configuration of the U-channel in order for instance to make a packing container from two U-channels nesting in each other.

The invention offers many embodiment modes such as are shown in particular in FIGS. 9 through 20, wherein, as aforementioned, the Figures denoted by (a) show the U channels in their operational configuration and the Figures denoted (b) are the structures in the storage and/or shipping configuration.

Figure 12:
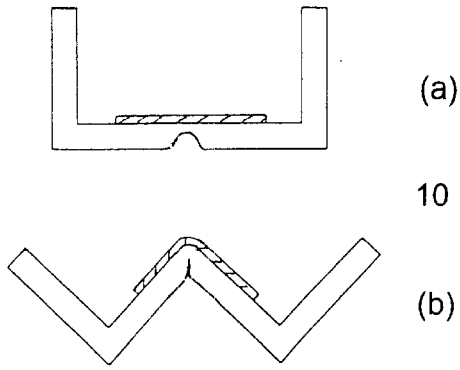
Figure 10:
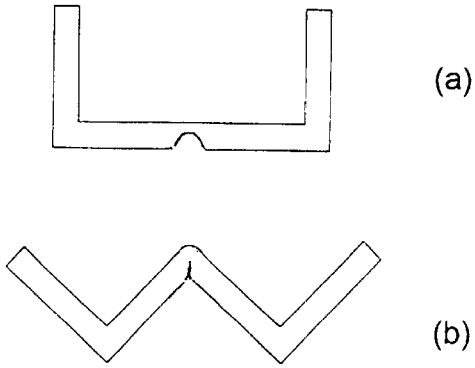
FIG. 10 shows a U-channel like that of FIG. 4 of which the groove was implemented by removing material.
Figure 13:
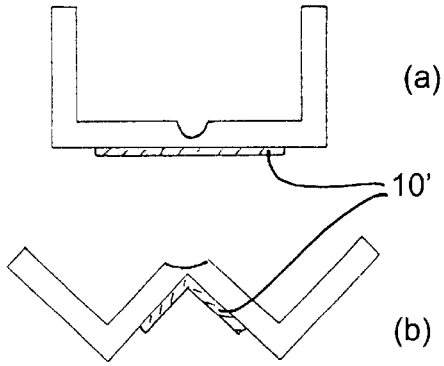
Figure 11:
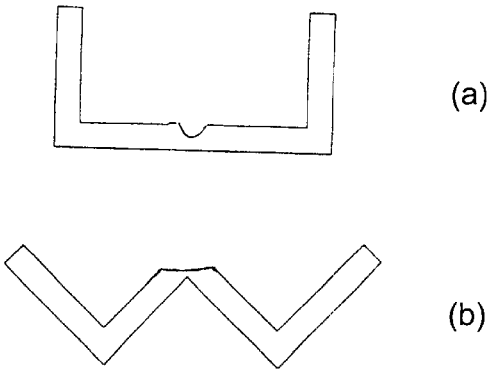
FIG. 11 shows an embodiment close to that of FIG. 10 however with the difference that the folding line is present on the inside of the U-channel's base.

FIGS. 12 and 13 correspond resp. to FIGS. 10 and 11, however in these latter embodiments, the folding line has been reinforced by a reinforcing tape 10, 10' applied to that side of the U-channel's base which is opposite the side containing the groove forming the folding line.

As shown in particular by FIGS. 12 and 13, the reinforcing tape is applied only over a portion of the base's width, even though it might be applied over all of it.

Figure 14:
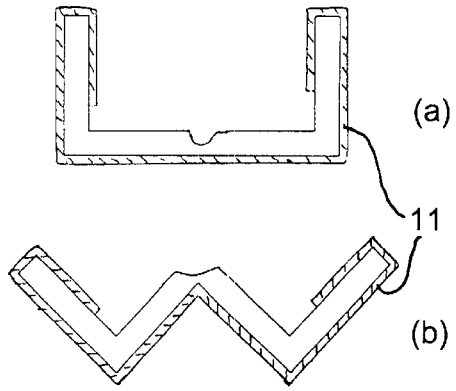

FIG. 14 corresponds to FIG. 13 but is fitted with a wrap 11 reinforcing the folding line while also wrapping a large part of the U-channel except for the side of the base containing the groove, such wrapping moreover optionally being rigidifying and/or esthetic.

Figure 1:
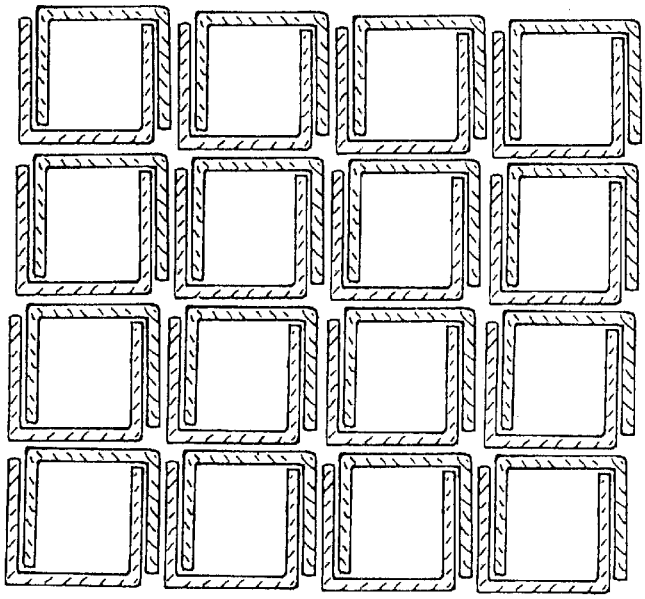
FIG. 1 (PRIOR ART)
Figure 2:
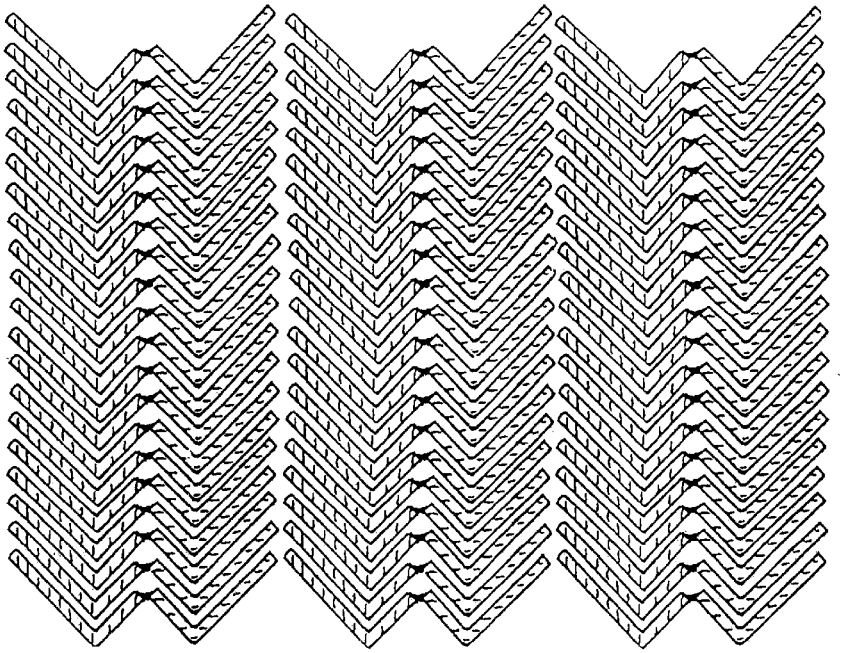
Figure 3:
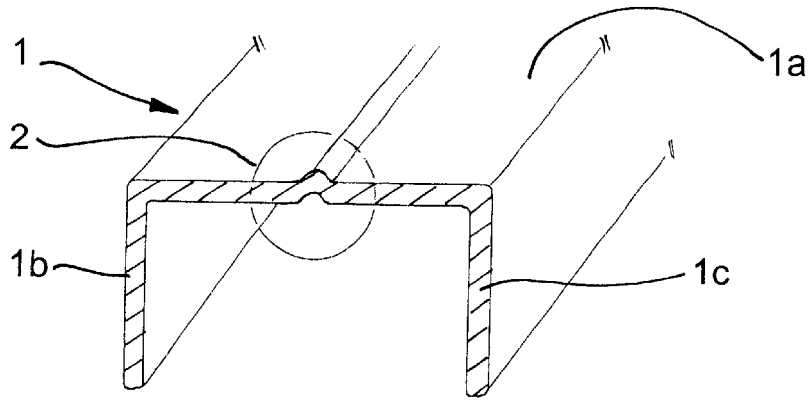
Figure 4:
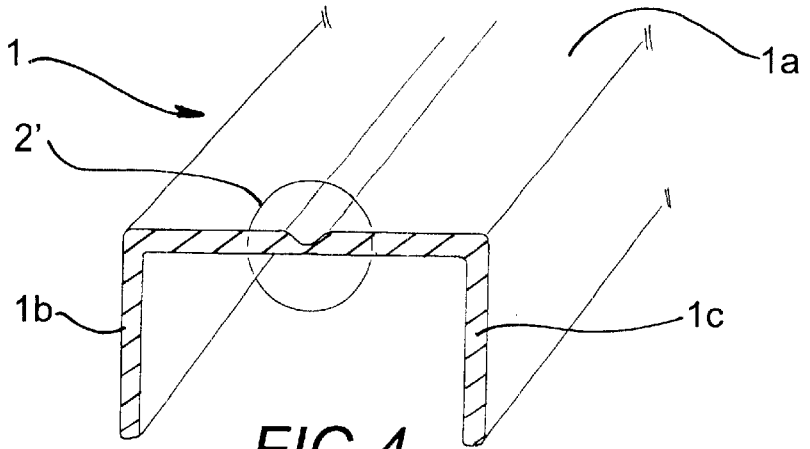
Figure 5:
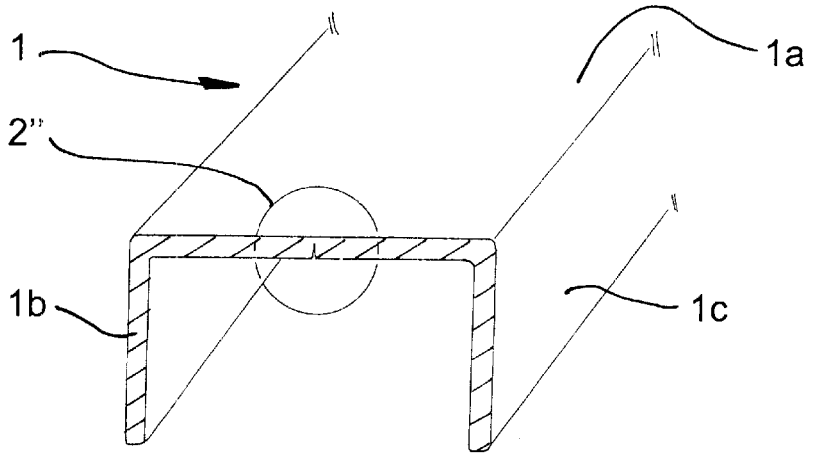
Figure 6:
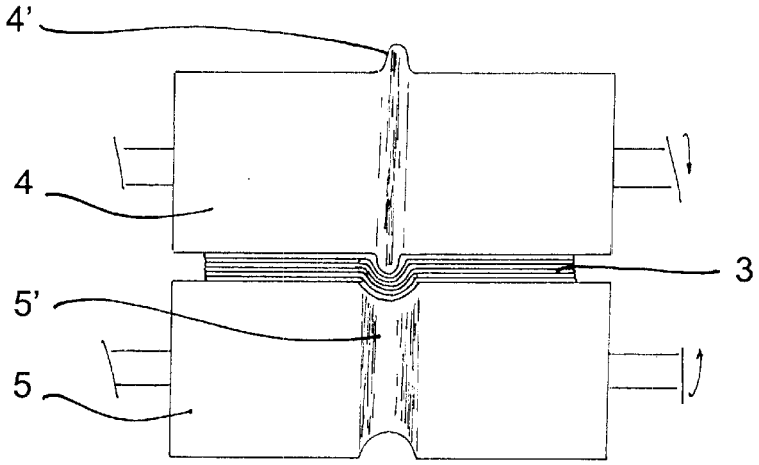
Figure 7:
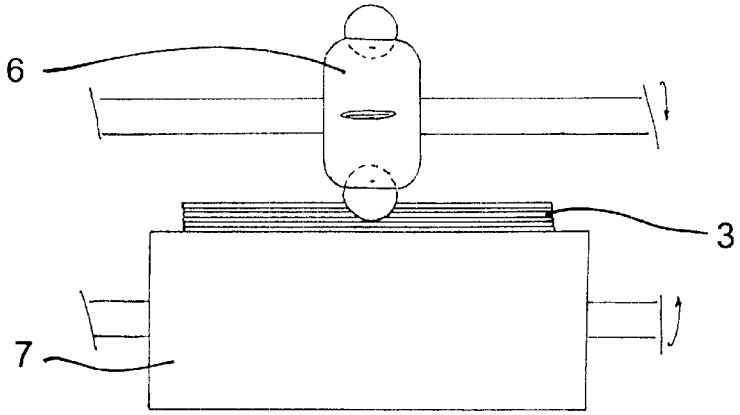
Figure 8:
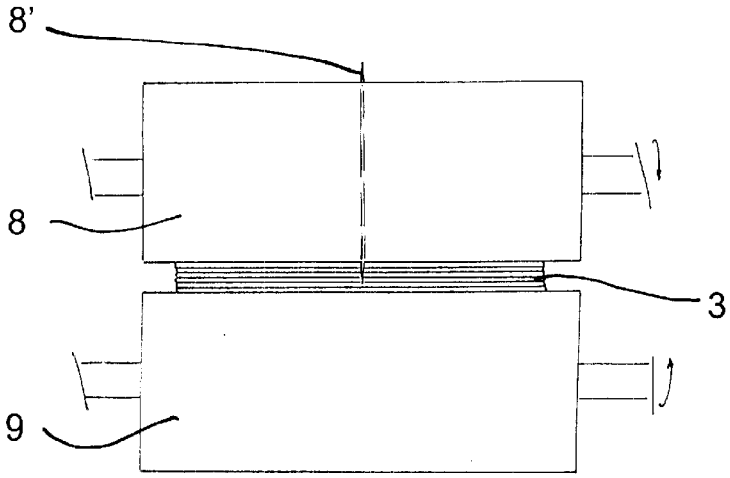
Figure 15:
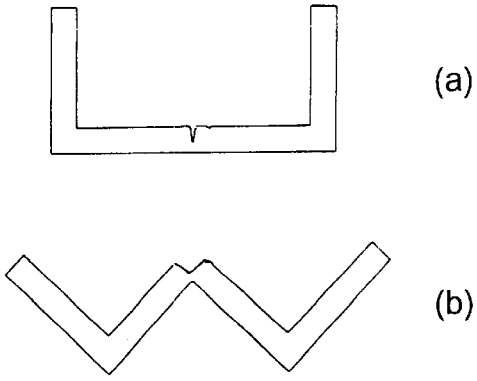

FIG. 15 shows a U-channel similar to that of FIG. 5 with a folding line or groove made by incision.

Figure 16:
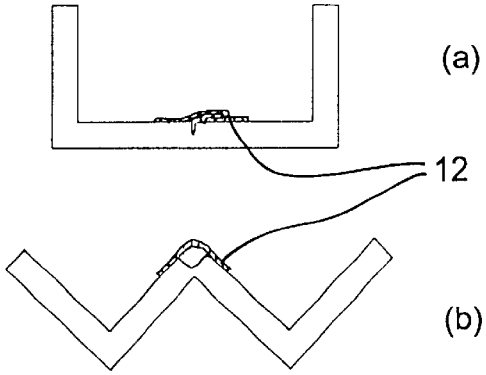
Figure 17:
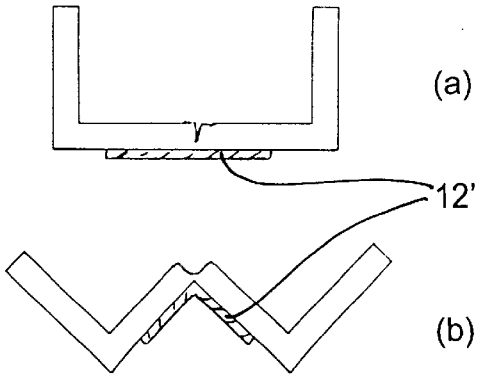

FIGS. 16 and 17 show U-channels fitted with incised grooves and further fitted with resp. reinforcing tapes 12, 12' applied to the incised base side (FIG. 16) or to the opposite side of the incision (FIG. 17), in the latter case corresponding to the embodiment of FIG. 13.

A significant particular design is provided in the illustration of FIG. 16.

To allow easy folding (see FIG. 16(*b*)), the reinforcing tape 12 is pleated in the zone of the incised groove (see FIG. 16(*a*)).

Figure 20:
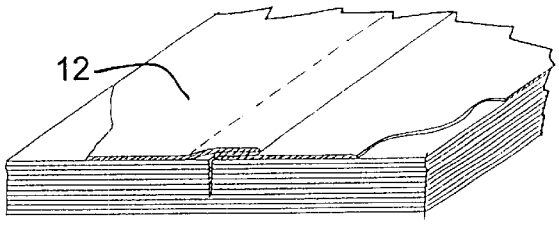

To implement the above pleat, that is a double zig-zag fold, any appropriate means may be used to fold and affix said tape after the incision has been made as shown in greater detail by FIG. 20.

Figure 18:
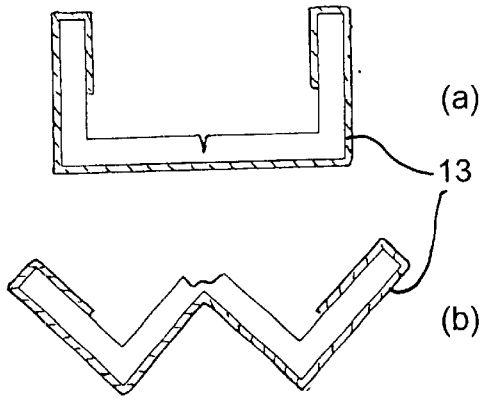

FIG. 18 shows a U-channel with a groove such as shown in FIGS. 15 through 17 and corresponds to FIG. 14 regarding the wrap which in this instance is denoted by 13.

Figure 19:
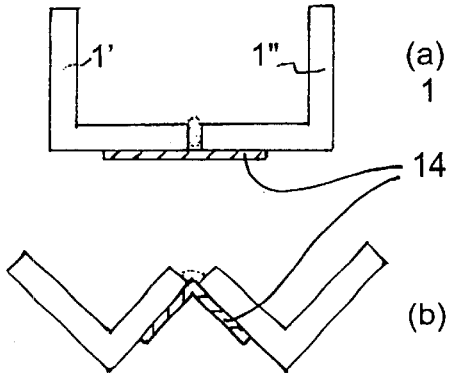

FIG. 19 is a very special embodiment wherein the U-channel is assembled from two L structures 1', 1" joined by the edges of one of their legs by means of a joining tape 14 apposed for instance by bonding to one side of said legs in the manner indicated in FIG. 19.

Moreover and in order to complement the latter embodiment, a joint may be provided consisting of glue and/or latex and/or silicone or the like and configured between the edges of said legs and shown in FIG. 19 in dots for the purpose of improving the hinge effect of this embodiment.

Figure 9:
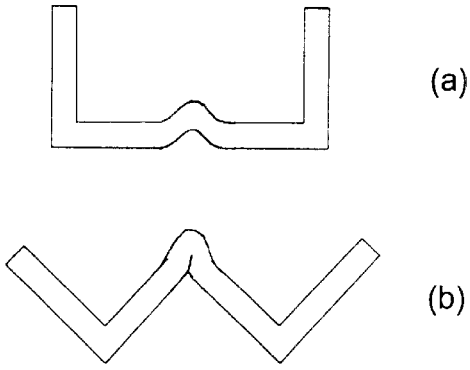
FIG. 9 shows a U-channel like that of FIG. 3, fitted with an impressed groove—which moreover might be implemented in concave manner on the outside surface of the base 1*a*.

Assuredly the invention also covers embodiments other than those shown above, for instance the embodiment of FIG. 9 fitted with a reinforcing tape, the embodiment of FIG. 19 fitted with a winder junction tape, etc.

What is claimed is:

1. A packaging member, comprising a base member having upper and lower surfaces, and a pair of longitudinal side members extending upwardly from and substantially perpendicularly to the upper surface of the base member;

the base member including a longitudinally extending folding line formed on at least one of the upper and lower surfaces, the folding line dividing the base member into two portions each bearing one of the side members and pivotable about the folding line;

said packaging member being disposed in a substantially U-shaped configuration when the two portions of the base member are flush with each other; and said packaging member being disposed in a substantially W-shaped configuration when the two portions of the base member are pivoted about the folding line with the respective side members moving away from each other, thereby facilitating stacking of a plurality of said packaging members disposed in the W-shaped configuration.

2. The packaging member of claim 1, wherein the folding line extending substantially centrally of the base member.

3. The packaging member of claim 1, wherein the base member of one said packaging member disposed in the U-shaped configuration cannot inserted into a space defined by the base and side members of another said packaging member also disposed in the U-shaped configuration.

4. The packaging member of claim 1, wherein said packaging member is integrally formed by folding opposite longitudinal side edges of the base member upwardly to form the side members.

5. The packaging member of claim 4, wherein said packaging member is made of one of cardboard including adhesively pasted strips and composite cardboard-polyolefins.

6. The packaging member of claim 1, wherein the folding line includes an indentation pressed into said at least one of the upper and lower surfaces without affecting the integrity of the base member.

7. The packaging member of claim 1, wherein the folding line includes a groove formed by partially removing a thickness of the base member.

8. The packaging member of claim 1, wherein the folding line includes a slit partially cut into a thickness of the base member.

9. The packaging member of claim 1, further comprising a reinforcing tape disposed on the base member in a region of the folding line to additionally join the two portions of the base member, thereby reinforcing the region of the folding line.

10. The packaging member of claim 9, wherein the folding line includes a slit partially cut from said at least one of the upper and lower surfaces into a thickness of the base member, and the reinforcing tape is disposed with a pleat on said at least one of the upper and lower surfaces.

11. The packaging member of claim 9, wherein the reinforcing tape covers substantially an entire area of said packaging member except for said at least one of the upper and lower surfaces on which the folding line is formed.

12. The packaging member of claim 1, wherein the folding line completely separates the two portions of the base member, said packaging member further comprising a reinforcing tape disposed on the base member in a region of the folding line to join the two separate portions of the base member together.

13. The packaging member of claim 12, further comprising a joint made of at least one of glue, latex and silicone filled in a gap between the two separate portions of the base member to additionally join the two separate portions.

14. The packaging member of claim 12, wherein the reinforcing tape is disposed on the lower surface of the base member.

15. A packaging member, comprising a base member having upper and lower surfaces, and a pair of longitudinal side members extending upwardly from the upper surface of the base member;

the base member including a longitudinally extending folding line formed on one of the upper and lower surfaces without affecting the other, the folding line dividing the base member into two portions each bearing one of the side members and pivotable about the folding line;

said packaging member being disposed in a substantially U-shaped configuration when the two portions of the base member are flush with each other; and said packaging member being disposed in a substantially W-shaped configuration when the two portions of the base member are pivoted about the folding line with the respective side members moving away from each other, thereby facilitating stacking of a plurality of said packaging members disposed in the W-shaped configuration.

16. The packaging member of claim 15, wherein the folding line includes one of a groove and a slit extending from said one of the upper and lower surfaces toward the other and formed by partially removing material of a thickness of the base member and partially incising into the base member without removing material thereof, respectively.

17. The packaging member of claim 16, wherein the folding line is formed on the upper surface.

18. The packaging member of claim 16, wherein the folding line is formed on the lower surface.

19. The packaging member of claim 16, further comprising a reinforcing tape disposed on the base member in a region of the folding line to additionally join the two portions of the base member, thereby reinforcing the region of the folding line.

20. The packaging member of claim 19, wherein the reinforcing tape is attached to the base member without affecting the integrity thereof.

21. The packaging member of claim 19, wherein the reinforcing tape is disposed on said one of the upper and lower surfaces.

22. The packaging member of claim 19, wherein the folding line is formed on the other of the upper and lower surfaces.

23. The packaging member of claim 19, wherein the reinforcing tape covers substantially an entire area of said packaging member except for said one of the upper and lower surfaces on which the folding line is formed.

24. The packaging member of claim 23, wherein the folding line is formed on the upper surface and the reinforcing tape does not cover regions of side surfaces of the side members which are immediately adjacent to the upper surface.

25. The packaging member of claim 16, wherein the folding line includes the slit, said packaging member further comprising a reinforcing tape disposed with a pleat on said one of the upper and lower surfaces.

26. The packaging member of claim 25, wherein the folding line is formed on the upper surface.

27. A packaging member, comprising a base member having upper and lower surfaces, and a pair of longitudinal side members extending upwardly from the upper surface of the base member;

the base member including a longitudinally extending folding line formed on both of the upper and lower surfaces, the folding line dividing the base member into two portions each bearing one of the side members and pivotable about the folding line;

said packaging member being disposed in a substantially U-shaped configuration when the two portions of the base member are flush with each other; and said packaging member being disposed in a substantially W-shaped configuration when the two portions of the base member are pivoted about the folding line with the respective side members moving away from each other, thereby facilitating stacking of a plurality of said packaging members disposed in the W-shaped configuration.

28. The packaging member of claim 27, wherein the folding line includes an indentation pressed into the base member, the indentation having a convex shape on one of the upper and lower surfaces and a corresponding concave shape on the other the upper and lower surfaces.

29. The packaging member of claim 28, wherein the base member has a substantially uniform thickness in regions of the folding line and the two portions.

30. The packaging member of claim 27, wherein the folding line completely separates the two portions of the base member, said packaging member further comprising a reinforcing tape disposed on the base member in a region of the folding line to join the two separate portions of the base member together.

31. The packaging member of claim 30, further comprising a joint made of at least one of glue, latex and silicone filled in a gap between the two separate portions of the base member to additionally join the two separate portions.

32. The packaging member of claim 30, wherein the reinforcing tape is disposed on the lower surface of the base member.

* * * * *